US006339181B1

(12) United States Patent
Chen et al.

(10) Patent No.: US 6,339,181 B1
(45) Date of Patent: Jan. 15, 2002

(54) MULTIPLE FEED PROCESS FOR THE PRODUCTION OF PROPYLENE

(75) Inventors: Tan-Jen Chen; Philip A. Ruziska, both of Kingwood, TX (US); Gordon F. Stuntz, Baton Rouge, LA (US); Paul K. Ladwig, Randolph, NJ (US)

(73) Assignee: ExxonMobil Chemical Patents, Inc., Houston, TX (US)

( * ) Notice: Subject to any disclaimer, the term of this patent is extended or adjusted under 35 U.S.C. 154(b) by 0 days.

(21) Appl. No.: 09/436,561

(22) Filed: Nov. 9, 1999

(51) Int. Cl.[7] ..... C07C 4/06; C10G 11/00

(52) U.S. Cl. ..... 585/653; 585/300; 585/302; 585/330; 208/75; 208/78; 208/80; 208/92; 208/113

(58) Field of Search ..... 585/300, 302, 585/330, 653; 208/75, 78, 80, 92, 113

(56) References Cited

U.S. PATENT DOCUMENTS

| | | | | |
|---|---|---|---|---|
| 3,928,172 A | | 12/1975 | Davis, Jr. et al. | 208/77 |
| 4,666,875 A | | 5/1987 | Pellet et al. | 502/65 |
| 4,802,971 A | | 2/1989 | Herbst et al. | 208/13 |
| 4,830,728 A | | 5/1989 | Herbst et al. | 208/78 |
| 4,842,714 A | | 6/1989 | Pellet et al. | 208/114 |
| 4,980,053 A | | 12/1990 | Li et al. | 208/120 |
| 5,026,935 A | | 6/1991 | Leyshon et al. | 585/315 |
| 5,026,936 A | | 6/1991 | Leyshon et al. | 585/315 |
| 5,043,522 A | | 8/1991 | Leyshon et al. | 585/651 |
| 5,069,776 A | | 12/1991 | Biswas et al. | 208/120 |
| 5,146,028 A | * | 9/1992 | Job | 585/512 |
| 5,171,921 A | | 12/1992 | Gaffney et al. | 585/653 |
| 5,318,696 A | | 6/1994 | Kowalski | 208/120 |
| 5,326,465 A | | 7/1994 | Yongqing et al. | 208/120 |
| 5,358,918 A | | 10/1994 | Yukang et al. | 502/67 |
| 5,366,948 A | | 11/1994 | Absil et al. | 502/68 |
| 5,380,690 A | | 1/1995 | Zhicheng et al. | 502/65 |
| 5,456,821 A | | 10/1995 | Absil et al. | 208/114 |
| 5,675,050 A | | 10/1997 | Des Courieres et al. | 585/533 |
| 5,846,403 A | * | 12/1998 | Swan et al. | 208/113 |
| 6,069,287 A | * | 5/2000 | Ladwig et al. | 585/648 |
| 6,093,867 A | * | 7/2000 | Ladwig et al. | 585/648 |
| 6,106,697 A | * | 8/2000 | Swan et al. | 208/77 |
| 6,118,035 A | * | 9/2000 | Fung et al. | 585/653 |

FOREIGN PATENT DOCUMENTS

| | | |
|---|---|---|
| EP | 0109059 B1 | 7/1987 |
| EP | 0109060 B1 | 3/1997 |
| EP | 0921179 A | 6/1999 |
| FR | 2 690 922 A | 11/1993 |
| WO | WO 91/18851 | 12/1991 |

* cited by examiner

*Primary Examiner*—Walter D. Griffin
(74) *Attorney, Agent, or Firm*—C. L. Bell

(57) ABSTRACT

This invention relates to a process to produce propylene from a hydrocarbon feed stream, preferably a naphtha feed stream, comprising C5 and C6 components wherein a light portion having a boiling point range of 120° C. or less is introduced into a reactor separately from the other components of the feed stream.

31 Claims, 1 Drawing Sheet

MULTIPLE FEED PROCESS FOR THE PRODUCTION OF PROPYLENE

STATEMENT OF RELATED APPLICATIONS

U.S. Ser. No. 09/072,632 and U.S. Ser. No. 09/073,085 are related to this application.

FIELD OF THE INVENTION

This invention relates to a process to produce propylene from a hydrocarbon feed stream containing C5's and/or C6's, preferably a naphtha feed stream, where multiple feeds are used to feed portions of the feed stream into different portions of the reactor, or into different reactors.

BACKGROUND OF THE INVENTION

Propylene is an important chemical of commerce. In general propylene is largely derived from selected petroleum feed materials by procedures such as steam cracking which also produces high quantities of other materials. At times, there exists shortages of propylene which result in uncertainties in feed supplies, rapidly escalating raw material costs and similar situations which are undesirable from a commercial standpoint. Also due to imbalances in hydrocarbon values, economics favor using alternate feedstocks provided an effective process for forming propylene was available. Methods are known for the conversion of higher hydrocarbons to reaction mixtures comprised of the C2 and C3 lighter olefins. For example, EP 0 109 059 A and EP 0 109 060 A provide illustrative disclosures of conditions and catalysts which are effective for the conversion of higher hydrocarbons such as butenes to the lighter olefins. U.S. Ser. No. 07/343,097 likewise is believed to provide a detailed disclosure of prior methods for the production of lower olefins from higher hydrocarbon feed materials. In certain instances, it would be very advantageous to provide means for still further improving yields of propylene which result from the conversion of less expensive higher hydrocarbon feed materials.

Prior methods to produce propylene include:

1. The disproportionation or metathesis of olefins. See for example U.S. Pat. Nos. 3,261,879; 3,883,606; 3,915,897; 3,952,070; 4,180,524; 4,431,855; 4,499,328; 4,504,694; 4,517,401; 4,547,617.
2. U.S. Pat. No. 5,026,936 which discloses the selective production of propylene for C4 and higher hydrocarbons by reacting the feed with a zeolite, then the ethylene produced is passed to a metathesis zones where it is further converted to propylene. See also, U.S. Pat. Nos. 5,026,935; 5,171,921 and 5,043,522.
3. U.S. Pat. No. 5,043,522 which discloses using ZSM-5 with C4+ feeds to produce lighter olefins including propylene.
4. U.S. Pat. No. 4,830,728 discloses a fluid catalytic cracking (FCC) unit that is operated to maximize olefin production. The FCC unit has two separate risers into which a different feed stream is introduced. The operation of the risers is designed so that a suitable catalyst will act to convert a heavy gas oil in one riser and another suitable catalyst will act to crack a lighter olefin/naphtha feed in the other riser. Conditions within the heavy gas oil riser can be modified to maximize either gasoline or olefin production. The primary means of maximizing production of the desired product is by using a specified catalyst.
5. U.S. Pat. No. 5,069,776 teaches a process for the conversion of a hydrocarbonaceous feedstock by contacting the feedstock with a moving bed of a zeolitic catalyst comprising a zeolite with a pore diameter of 0.3 to 0.7 nm, at a temperature above about 500° C. and at a residence time less than about 10 seconds. Olefins are produced with relatively little saturated gaseous hydrocarbons being formed. Also, U.S. Pat. No. 3,928,172 teaches a process for converting hydrocarbonaceous feedstocks wherein olefins are produced by reacting said feedstock in the presence of a ZSM-5 catalyst.
6. Concurrently pending U.S. Ser. No. 09/072,632 discloses a method to improve the yield of propylene by selecting certain reaction conditions and certain catalysts.

Thermal and catalytic conversion of hydrocarbons to olefins is an important industrial process producing millions of pounds of olefins each year. Because of the large volume of production, small improvements in operating efficiency translate into significant profits. Catalysts play an important role in more selective conversion of hydrocarbons to olefins.

While important catalysts are found among the natural and synthetic zeolites, it has also been recognized that non-zeolitic molecular sieves such as silicoaluminophosphates (SAPO) including those described in U.S. Pat. No. 4.440,871 also provide excellent catalysts for cracking to selectively produce light hydrocarbons and olefins. The SAPO molecular sieve has a network of $AlO_4$, $SiO_4$, and $PO_4$ tetrahedra linked by oxygen atoms. The negative charge in the network is balanced by the inclusion of exchangeable protons or cations such as alkali or alkaline earth metal ions. The interstitial spaces or channels formed by the crystalline network enables SAPOs to be used as molecular sieves in separation processes and in catalysis. There are a large number of known SAPO structures. The synthesis and catalytic activity of the SAPO catalysts are disclosed in U.S. Pat. No. 4,440,871.

SAPO catalysts mixed with zeolites (including rare earth exchanged zeolites) are known to be useful in cracking of gasoils (U.S. Pat. No. 5,318,696). U.S. Pat. Nos. 5,456,821 and 5,366,948 describe cracking catalysts with enhanced propylene selectivity which are mixtures of phosphorus treated zeolites with a second catalyst which may be a SAPO or a rare earth exchanged zeolite. Rare earth treated zeolite catalysts useful in catalytic cracking are disclosed in U.S. Pat. Nos. 5,380,690, 5,358,918, 5,326,465, 5232,675 and 4,980,053. Thus there is a need on the art to provide more processes to increase the yields of propylene produced from higher olefin feed stocks such as naphtha feed stocks.

SUMMARY OF THE INVENTION

This invention relates to a process to produce propylene from a hydrocarbon feed stream comprising C5's and/or C6's comprising introducing the light portion of the feed stream into a reactor containing one or more catalysts separately from the heavy portion of the feed stream, wherein the light portion of the feedstream comprises that portion of the feed stream that boils at 120° C. or less, and the heavy portion of the feed stream is that portion left over after the light portion is removed.

BRIEF DESCRIPTION OF THE DRAWINGS

In FIG. 3, A and B are different catalysts.

DETAILED DESCRIPTION OF THE INVENTION

Figure 1:
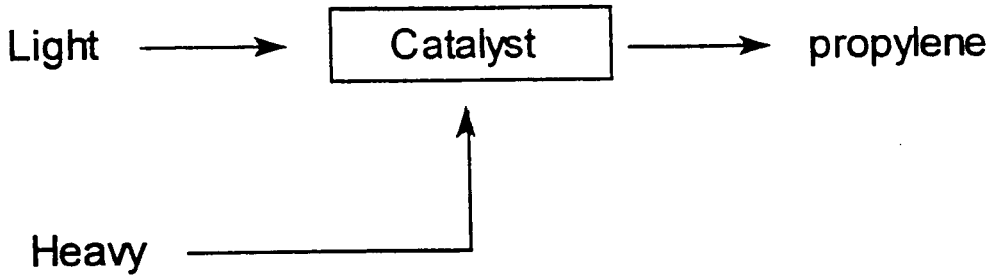
FIGS. 1, 2, and 3 depict possible configurations for the multiple feeds into one or more reactors.

This invention particularly relates to a process to produce propylene from a hydrocarbon feed stream containing C5's and/or C6's comprising introducing the light portion of the of the feed stream into a reactor separately from the heavy components of the feed stream, where light portion of the feed stream is that portion that has a boiling point range of 120° C. or less, more preferably 100° C. or less, even more preferably 80° C. or less. The heavy portion of the feed stream is the portion left over after the light portion has been removed. In a preferred embodiment the light portion comprises C5 and/or C6 components. In a particularly preferred embodiment the light portion comprises at least 50 weight %, preferably at least 75 weight %, more preferably at least 90 weight %, more preferably at least 98 weight %, of the C5's and/or C6's present in a feed stream, preferably a naphtha feed stream. In another embodiment, the light portion comprises C5 components, preferably at least 50 weight %, preferably at least 75 weight %, more preferably at least 90 weight %, more preferably at least 98 weight %, of the C5's present in a feed stream, preferably a naphtha feed stream.

The process of the invention can be used on any hydrocarbon stream containing olefins, particularly C5's and/or C6's, which can be divided into light and heavy fractions. In a preferred embodiment the invention is practiced on a hydrocarbon stream comprising C5's and/or C6's. In preferred embodiments, a catalytically or thermally cracked naphtha stream is the feed stream. Such streams can be derived from any appropriate source, for example, they can be derived from the fluid catalytic cracking (FCC) of gas oils and resids, or they can be derived from delayed or fluid coking of resids. In one embodiment the naphtha streams used in the practice of the present invention is derived from the fluid catalytic cracking of gas oils and resids. Such naphthas are typically rich in olefins and/or diolefins and relatively lean in paraffins.

By C5's and C6's is meant a hydrocarbon feed stream containing linear, branched or cyclic paraffins, olefins, or aromatics, having 5 or 6 carbon atoms, respectively. Examples include, pentane, cyclopentene, cyclopentane, cyclohexane, pentene, pentadiene cyclopentadiene, hexene, hexadiene, and benzene.

The heavy portion of the hydrocarbon feed typically includes hydrocarbons having one more carbon than those in the light portion, In one embodiment the heavy component comprises hydrocarbons having 7 or more carbon atoms, typically between 7 and 12 carbon atoms. Examples include heptane, heptene, octane, octene, toluene and the like. In other embodiments the heavy portion comprises hydrocarbons having 6 or more carbon atoms, typically between 6 and 12 carbon atoms. Examples include hexane, cyclohexane, benzene, hexadiene, heptane, heptene, octane, octene, toluene and the like.

Preferred catalytically cracked feedstreams which are suitable for the practice of this invention include those streams boiling in the naphtha range and containing from about 5 wt. % to about 70 wt. %, preferably from about 10 wt. % to about 60 wt. %, and more preferably from about 10 to 50 wt. % paraffins, and from about 10 wt. %, preferably from about 20 wt. % to about 70 wt. % olefins. The feed may also contain naphthenes and aromatics. Naphtha boiling range streams are typically those having a boiling range from about 65° F. to about 430° F. (18–220° C.), preferably from about 65° F. to about 300° F.(18–149° C.).

In some embodiments steam may be co-fed with the naptha. The amount of steam co-fed with the naphtha feedstream may be in the range of about 10 to 250 mol. %, preferably from about 25 to 150 mol. % steam to naphtha.

The catalysts that may be used in the practice of the invention include those which comprise a crystalline zeolite having an average pore diameter less than about 0.7 nanometers (nm), said crystalline zeolite comprising from about 10 wt. % to about 50 wt. % of the total fluidized catalyst composition. It is preferred that the crystalline zeolite be selected from the family of medium pore size (<0.7 nm) crystalline aluminosilicates, otherwise referred to as zeolites. The pore diameter also sometimes referred to as effective pore diameter can be measured using standard adsorption techniques and hydrocarbonaceous compounds of known minimum kinetic diameters. See Breck, *Zeolite Molecular Sieves*, 1974 and Anderson et al., J. Catalysis 58, 114 (1979), both of which are incorporated herein by reference.

Medium pore size zeolites that can be used in the practice of the present invention are described in "Atlas of Zeolite Structure Types", eds. W. H. Meier and D. H. Olson, Butterworth-Heineman, Third Edition, 1992, which is hereby incorporated by reference. The medium pore size zeolites generally have a pore size from about 5Å, to about 7Å and include for example, MFI, MFS, MEL, MTW, EUO, MTT, HEU, FER, and TON structure type zeolites (IUPAC Commission of Zeolite Nomenclature). Non-limiting examples of such medium pore size zeolites, include ZSM-5, ZSM-12, ZSM-22, ZSM-23, ZSM-34, ZSM-35, ZSM-38, ZSM-48, ZSM-50, and silicalite. The most preferred is ZSM-5, which is described in U.S. Pat. Nos. 3,702,886 and 3,770,614. ZSM-11 is described in U.S. Pat. No. 3,709,979; ZSM-12 in U.S. Pat. No. 3,832,449; ZSM-21 and ZSM-38 in U.S. Pat. No. 3,948,758; ZSM-23 in U.S. Pat. No. 4,076,842; and ZSM-35 in U.S. Pat. No. 4,016,245. All of the above patents are incorporated herein by reference.

Other suitable medium pore size molecular sieves include the silicoaluminophosphates (SAPO), such as SAPO-4 and SAPO-11 which is described in U.S. Pat. No. 4,440,871; chromosilicates; gallium silicates; iron silicates; aluminum phosphates (ALPO), such as ALPO-11 described in U.S. Pat. No. 4,310,440; titanium aluminosilicates (TASO), such as TASO-45 described in EP-A No. 229,295; boron silicates, described in U.S. Pat. No. 4,254,297; titanium aluminophosphates (TAPO), such as TAPO-11 described in U.S. Pat. No. 4,500,651; and iron aluminosilicates. The medium pore size zeolites can include "crystalline admixtures" which are thought to be the result of faults occurring within the crystal or crystalline area during the synthesis of the zeolites. Examples of crystalline admixtures of ZSM-5 and ZSM-11 are disclosed in U.S. Pat. No. 4,229,424 which is incorporated herein by reference. The crytalline admixtures are themselves medium pore size zeolites and are not to be confused with physical admixtures of zeolites in which distinct crystals of crystallites of different zeolites are physically present in the same catalyst composite or hydrothermal reaction mixtures.

The catalysts of the present invention may be held together with an inorganic oxide matrix component. The inorganic oxide matrix component binds the catalyst components together so that the catalyst product is hard enough to survive interparticle and reactor wall collisions. The inorganic oxide matrix can be made from an inorganic oxide sol or gel which is dried to "glue" the catalyst components together. Preferably, the inorganic oxide matrix is not catalytically active and will be comprised of oxides of silicon and aluminum. It is also preferred that separate alumina phases be incorporated into the inorganic oxide matrix. Species of aluminum oxyhydroxides-g-alumina, boehmite, diaspore, and transitional aluminas such as α-alumina, β-alumina, χ-alumina, δ-alumina, ϵ-alumina, γ-alumina, and r-alumina can be employed. Preferably, the alumina species is an aluminum trihydroxide such as gibbsite, bayerite, nordstrandite, or doyelite. The matrix material may also contain phosphorous or aluminum phosphate.

Preferred silicoaluminophosphate (SAPO) catalysts useful in the present invention have a three-dimensional microporous crystal framework structure of $PO_2^+$, $AlO_2^-$and $SiO_2$ tetrahedral units, and whose essential empirical chemical composition on an anhydrous basis is: m R:(Si[x]Al[y]P[z])O[2 ] wherein "R" represents at least one organic templating agent present in the intracrystalline pore system: "m" represents the moles of "R" present per mole of (Si[x]Al[y]P[z])O2 and has a value of from zero to 0.3, the maximum value in each case depending upon the molecular dimensions of the templating agent and the available void volume of the pore system of the particular silicoaluminophosphate species involved, "x", "y" and "z" represent the mole fractions of silicon, aluminum and phosphorus, respectively, present as tetrahedral oxides, representing the following values for "x", "y" and "z".

| Mole Fraction | | |
|---|---|---|
| x | y | z |
| 0.01 | 0.47 | 0.52 |
| 0.94 | 0.01 | 0.05 |
| 0.98 | 0.01 | 0 01 |
| 0.39 | 0.60 | 0.01 |
| 0.01 | 0.60 | 0.39 |

When synthesized in accordance with the process disclosed in U.S. Pat. No. 4,440,871, the minimum value of "m" in the formula above is 0.02. In a preferred sub-class of the SAPOs useful in this invention, the values of "x", "y" and "z" in the formula above are set out in the following table:

| Mole Fraction | | |
|---|---|---|
| x | y | z |
| 0.02 | 0.49 | 0.49 |
| 0.25 | 0.37 | 0.38 |
| 0.25 | 0.48 | 0.27 |
| 0.13 | 0.60 | 0.27 |
| 0.02 | 0.60 | 0.38 |

Preferred SAPO catalysts include SAPO-11, SAPO-17, SAPO-31, SAPO-34, SAPO-35, SAPO-41, and SAPO-44.

The catalysts suitable for use in the present invention include, in addition to the SAPO catalysts, the metal integrated aluminophosphates (MeAPO and ELAPO) and metal integrated silicoaluminophosphates (MeAPSO and ElAPSO). The MeAPO, MeAPSO, ElAPO, and ElAPSO families have additional elements included in their framework. For example, Me represents the elements Co, Fe, Mg, Mn, or Zn, and El represents the elements Li, Be, Ga, Ge, As, or Ti. Preferred catalysts include MeAPO-11, MeAPO-31, MeAPO-41, MeAPSO-11, MeAPSO-31, and MeAPSO-41, MeAPSO-46, ElAPO-11, ElAPO-31, ElAPO-41, ElAPSO-11, ElAPSO-31, and ElAPSO-41.

The non-zeolitic SAPO, MeAPO, MeAPSO, ElAPO and EIAPSO classes of microporus materials are further described in the "Atlas of Zeolite Structure Types" by W. M. Meier, D. H. Olson and C. Baerlocher (4th ed., Butterworths/Intl. Zeolite Assoc. (1996) and "Introduction to Zeolite Science and Practice", H. Van Bekkum, E. M. Flanigen and J. C. Jansen Eds., Elsevier, N.Y., (1991).).

The selected catalysts may also include cations selected from the group consisting of cations of Group IIA, Group IIIA, Groups IIIB to VIIBB and rare earth cations selected from the group consisting of cerium, lanthanum, praseodymium, neodymium, promethium, samarium, europium, gadolinium, terbium, dysprosium, holmium, erbium, thulium, ytterbium, lutetium and mixtures thereof.

Other useful catalysts are described in U.S. Pat. No. 5,675,050, International Application WO 91/18851, U.S. Pat. No. 4,666,875, and U.S. Pat. No. 4,842,714.

In the practice of this invention the light portion is introduced separately from the heavy portion. In a single reactor system, the light portion is introduced at a different location from the heavy portion. In a multiple reactor system the light portion is introduced into a different reactor.

In one embodiment, the light portion is introduced into the reactor at a point before the point where the heavy portion(s) of the feed stream is introduced into the reactor. This is illustrated in FIG. 1. Preferably, the heavy portion of the feed stream is introduced into the reactor at a point that is at least ⅓ of the total length of the reaction chamber apart from the point where the light portion is introduced. More preferably, the heavy portion of the feed stream is introduced into the reactor at a point that is at least ½ of the total length of the reaction chamber apart from the point where the light portion is introduced. Even more preferably, the heavy portion of the feed stream is introduced into the reactor at a point that is ⅓ to ½ of the total length of the reaction chamber apart from the point where the light portion is introduced.

In another embodiment, the separate portions are introduced into a staged bed reactor. Preferably one portion is introduced so as to react with the first bed and the second portion is introduced so as to react with the second bed. The effluent from the first bed can be withdrawn prior to entering the second bed area or can be passed through the second bed.

Figure 2:
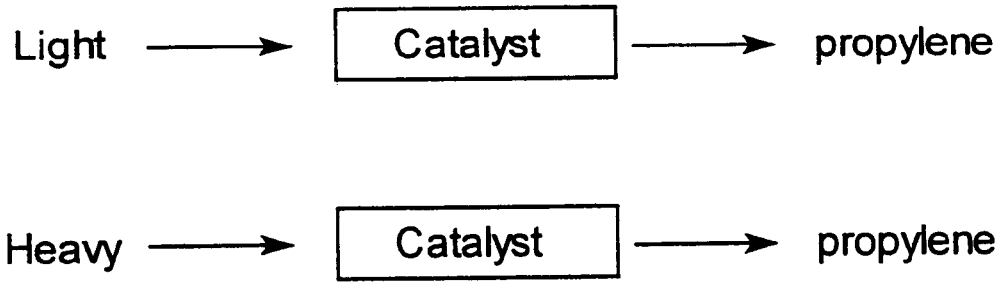
Figure 3:
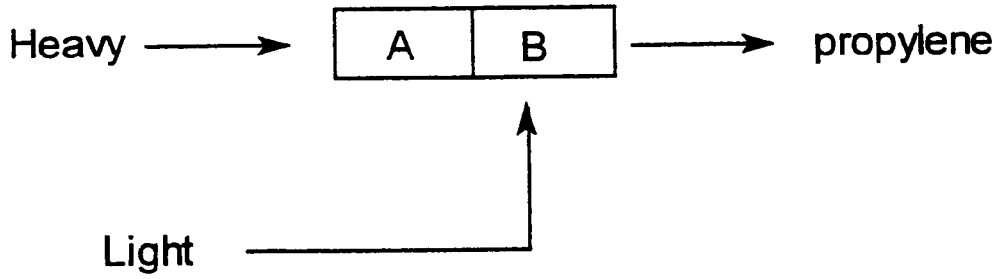

In another embodiment, the separate portions are reacted in separate reactors. For example, the processes described above may further comprise a second reactor wherein the light portion(s) is introduced into a first reactor and the heavy portion(s) of the feed stream is introduced into the second reactor. This is illustrated in FIG. 2. The two reactors may be arranged in series or in parallel.

The multiple portions of the feed stream may be reacted with the same or different catalysts In one embodiment they are reacted with the same catalyst(s). In a preferred embodiment the heavy and light portions of a naphtha feed are reacted over a medium pore silicoaluminophosphate catalyst such as SAPO-11, RE SAPO-11, SAPO-41, and/or RE SAPO-41.

In another embodiment the light and heavy portions are reacted with different catalysts. Preferably, in the practice of this invention the light portion of the naphtha feed stream is reacted with silicoaluminophosphates, such as SAPO-11, SAPO-41, rare earth ion exchanged SAPO-11, and/or rare earth ion exchanged SAPO-41 while the heavy portion is reacted over medium pore crystalline aluminosilicate zeolites such as ZSM-5, ZSM-11, ZSM-23, ZSM-48 and/or ZSM-22.

In another embodiment the reactor is a staged bed reactor and first staged bed comprises one or more medium pore crystalline aluminosilicate zeolite catalysts such as ZSM-5, ZSM-11, and/or ZSM-22, and the heavy portion of the feed stream is introduced into the reactor such that it will react with the zeolite catalyst, while the second stage bed comprises medium pore silicoaluminophosphate molecular sieve catalysts such as SAPO-11, SAPO-41, rare earth SAPO-11, and/or rare earth SAPO-41 and the lighter portion of the feed stream is introduced into the reactor such that it will react with the silicoaluminaphosphate catalyst. The first and second staged beds may be in single or separate reactors.

The reactors that may be used in the practice of this invention include fixed bed reactors, fluidized bed reactors, moving bed reactors, staged reactors, transfer line reactors, riser reactors and the like.

The propylene produced herein preferably comprises at least 80 mole % propylene, preferably at least 95 mole %, more preferably 97 mole % based upon the total product produced.

The processes described herein produce product comprising at least 20 weight % propylene, preferably at least 25 weight % propylene, based upon the weight of the total product produced.

The reactions are performed under conditions generally known in the art. For example, preferred conditions include a catalyst contacting temperature in the range of about 400° C. to 750° C., more preferably in the range of 450° C. to 700° C., most preferably in the range of 500° C. to 650° C. The catalyst contacting process is preferably carried out at a weight hourly space velocity (WHSV) in the range of about 0.1 $Hr^{-1}$ to about 300 $Hr^{-1}$, more preferably in the range of about 1.0 $Hr^{-1}$ to about 250 $Hr^{-1}$, and most preferably in the range of about 10 $Hr^{-1}$ to about 100 $Hr^{-1}$. Pressure in the contact zone may be from 0.1 to 30 atm. absolute (10–3040 kPa), preferably 1 to 3 atm. absolute (101–304 kPa), most preferably about 1 atm. absolute (101 kPa). The catalyst may be contacted in any reaction zone such as a fixed bed, a moving bed, a transfer line, a riser reactor or a fluidized bed.

In one preferred embodiment the reaction conditions include temperatures from about 500° C. to about 650° C., preferably from about 500° C. to 600° C.; hydrocarbon partial pressures from about 10 to 40 psia(69–276 kPa), preferably from about 20 to 35 psia (138–241 kPa); and a catalyst to feed (wt/wt) ratio from about 3 to 12, preferably from about 4 to 10, where catalyst weight is total weight of the catalyst composite. On one embodiment steam may be concurrently introduced with the feed stream into the reaction zone, with the steam comprising up to about 50 wt. % of the hydrocarbon feed. The feed residence time in the reaction zone is preferably less than about 10 seconds, for example from about 1 to 10 seconds.

Different reaction conditions may be used in different areas of the reactor or in different reactors if more than one reactor is being used.

It is within the scope of this invention that the catalysts be precoked prior to introduction of feed in order to further improve the selectivity to propylene. It is also within the scope of this invention that an effective amount of single ring aromatics be fed to the reaction zone to also improve the selectivity of propylene vs. ethylene. The aromatics may be from an external source such as a reforming process unit or they may consist of heavy naphtha recycle product from the instant process.

In another preferred embodiment, the process described herein is operated in the absence of a superfractionator.

In another embodiment, this invention relates to a process of polymerizing propylene comprising obtaining propylene produced by the process described herein and thereafter contacting the propylene and optionally other olefins, with an olefin polymerization catalyst. In a preferred embodiment the olefin polymerization catalyst may comprise one or more Ziegler-Natta catalysts, conventional-type transition metal catalyst, metallocene catalysts, chromium catalysts, or vanadium catalysts.

Ziegler-Natta catalysts include those Ziegler-Natta catalysts as described in *Ziegler-Natta Catalysts and Polymerizations*, John Boor, Academic Press, New York, 1979. Examples of conventional-type transition metal catalysts are also discussed in U.S. Pat. Nos. 4,115,639, 4,077,904, 4,482,687, 4,564,605, 4,721,763, 4,879,359 and 4,960,741 all of which are herein fully incorporated by reference.

Conventional-type transition metal catalyst compounds based on magnesium/titanium electron-donor complexes that are useful in the invention are described in, for example, U.S. Pat. Nos. 4,302,565 and 4,302,566, which are herein fully incorporate by reference. The $MgTiCl_6$ (ethyl acetate)$_4$ derivative is particularly preferred.

British Patent Application 2,105,355 and U.S. Pat. No. 5,317,036, herein incorporated by reference, describes various conventional-type vanadium catalyst compounds. Non-limiting examples of conventional-type vanadium catalyst compounds include vanadyl trihalide, alkoxy halides and alkoxides such as $VOCl_3$, $VOCl_2$(OBu) where Bu=butyl and $VO(OC_2H_5)_3$; vanadium tetra-halide and vanadium alkoxy halides such as $VCl_4$ and $VCl_3$(OBu); vanadium and vanadyl acetyl acetonates and chloroacetyl acetonates such as $V(AcAc)_3$ and $VOCl_2$(AcAc) where (AcAc) is an acetyl acetonate. The preferred conventional-type vanadium catalyst compounds are $VOCl_3$, $VCl_4$ and $VOCl_2$—OR where R is a hydrocarbon radical, preferably a $C_1$ to $C_{10}$ aliphatic or aromatic hydrocarbon radical such as ethyl, phenyl, isopropyl, butyl, propyl, n-butyl, iso-butyl, tertiary-butyl, hexyl, cyclohexyl, naphthyl, etc., and vanadium acetyl acetonates.

Conventional-type chromium catalyst compounds, often referred to as Phillips-type catalysts, suitable for use in the present invention include $CrO_3$, chromocene, silyl chromate, chromyl chloride ($CrO_2CI_2$), chromium-2-ethyl-hexanoate, chromium acetylacetonate ($Cr(AcAc)_3$), and the like. Non-limiting examples are disclosed in U.S. Pat. Nos. 3,709,853, 3,709,954, 3,231,550, 3,242,099 and 4,077,904, which are herein fully incorporated by reference.

Still other conventional-type transition metal catalyst compounds and catalyst systems suitable for use in the present invention are disclosed in U.S. Pat. Nos. 4,124,532, 4,302,565, 4,302,566, 4,376,062, 4,379,758, 5,066,737, 5,763,723, 5,849,655, 5,852,144, 5,854,164 and 5,869,585 and published EP-A2 0 416 815 A2 and EP-A1 0 420 436, which are all herein incorporated by reference.

Other catalysts may include cationic catalysts such as $AlCl_3$, and other cobalt, iron, nickel and palladium catalysts well known in the art. See for example U.S. Pat. Nos. 3,487,112, 4,472,559, 4,182,814 and 4,689,437 all of which are incorporated herein by reference.

Other metallocene-type catalyst compounds and catalyst systems useful in the invention may include those described in U.S. Pat. Nos. 5,064,802, 5,145,819, 5,149,819, 5,243,001, 5,239,022, 5,276,208, 5,296,434, 5,321,106, 5,329,031, 5,304,614, 5,677,401, 5,723,398, 5,753,578, 5,854,363, 5,856,547 5,858,903, 5,859,158, 5,900,517 and 5,939,503 and PCT publications WO 93/08221, WO 93/08199, WO 95/07140, WO 98/11144, WO 98/41530, WO 98/41529, WO 98/46650, WO 99/02540 and WO 99/14221 and European publications EP-A-0 578 838, EP-A-0 638 595, EP-B-0

513 380, EP-A1-0 816 372, EP-A2-0 839 834, EP-B1-0 632 819, EP-B1-0 748 821 and EP-B1-0 757 996, all of which are herein fully incorporated by reference.

In one embodiment, metallocene-type catalysts compounds usefull in the invention include bridged heteroatom, mono-bulky ligand metallocene-type compounds. These types of catalysts and catalyst systems are described in, for example, PCT publication WO 92/00333, WO 94/07928, WO 91/04257, WO 94/03506, WO 96/00244, WO 97/15602 and WO 99/20637 and U.S. Pat. Nos. 5,057,475, 5,096,867, 5,055,438, 5,198,401, 5,227,440 and 5,264,405 and European publication EP-A-0 420 436, all of which are herein fully incorporated by reference.

EXAMPLES

In the examples below the reactions were preformed in a 50 cc fixed bed reactor operated under a controlled pressure of 6 psig (0.04 MPa). THe feed rate was 0.36 g/min. The effluent stream was analyzed by on-line gas chromotography. A column having a length of 60m packed with a dual flame ionization detector (FID) Hewlett Packard Model 5880. In Examples 1, 2 and 3 a diluent of steam was also fed into the reactor at a steam to hydrocarbon ratio of 0.2. In Examples 4, 5 and 6 a diluent of steam was also fed into the reactor at a steam to hydrocarbon ratio of 1.5.

Example 1 (comparative)

In this example, a blend of model compounds consisting of 16.7wt % 1-pentene, 15.6wt % 1-hexene, 11.4wt % 1-heptene, 4.4 wt % 1-octene, 1.3wt % nonene, 1.0wt % 1-decene, 11.7wt % n-pentane, 11.5wt % n-hexane, 5.7wt % n-heptane, 5.0wt % n-octane, 2.5wt % n-nonane, 1.7wt % n-octane, 0.6wt % benzene, 2.8wt % toluene, and 8.1 wt % mixed xylenes was prepared to simulate refinery light catalyitically cracked naphtha. This simulated light cat naphtha was then cracked over a commercial ZSM-5 catalyst at 50 $hr^{-1}$ WHSV and 590° C. with 0.2 steam/hydrocarbon.

As can be seen from Table 1, the propylene yield obtained in cracking of the simulated light cat naphtha over the commercial ZSM-5 catalyst is 19.8wt % propylene at 95% purity level in the $C_3$ stream. Ethylene yield was 4.7wt %.

Example 2 (comparative)

In this example, the same blend of model compounds was cracked over a rare earth SAPO-11 catalyst. As can be seen from Table 1, the propylene yield obtained in cracking of the simulated light cat naphtha over the rare earth ion exchanged SAPO-11 catalyst is 24.4wt % propylene at 95% purity level in the $C_3$ stream. Ethylene yield was 5.1wt %.

Example 3

In this example, a blend consisting of 60.0wt % 1-pentene and 40.0wt % n-pentane was prepared to simulate the $C_5$ cut of a refinery light cat naphtha. Separately, a blend consisting of 21.8wt % 1-hexene, 15.9wt % 1-heptene, 6.2wt % 1-octene, 1.9wt % 1-nonene, 1.4wt % 1-decene, 16.1 wt % n-hexane, 8.0wt % n-heptane, 7.0wt % n-octane, 3.5wt % nonane, 2.4wt % decane, 0.8wt % benzene, 3.9wt % toluene, and 11.3wt % mixed xylenes was prepared to simulate the C6+ cut of the refinery light cat naphtha. This simulated C5 cut and C6+ cuts were cracked separately over the same rare earth ion exchanged SAPO-11. The residence time in the second reaction was calculated to simulate the shortened residence time of a feed stream injected at a point further along the reactor than the injection point of the first fraction.

As can be seen from Table 1, propylene yield was 26.0wt % at 95% purity level in the C3 cut. Ethylene yield was improved to 8.6wt %. This example illustrates the benefit of splitting the feed and cracking the feed fractions separately over the cracking catalyst.

Example 4 (comparative)

In this example, a blend of model compounds consisting of 19.0 wt % 1-pentene, 20.4wt % 1-hexene, 15.1 wt % 1-heptene, 1.1wt % 1-octene, 10.4wt % n-pentane, 14.7% n-hexane, 13.5wt % n-heptane, 1.4 wt % n-octane, 1.1wt % benzene, and 3.3wt % toluene was prepared to simulate another refinery light cat naphtha. This simulated light cat naphtha was then cracked over a commercial ZSM-5 catalyst at 7.2 $hr^{-1}$ WHSV and 600° C. with 1.5 steam/hydrocarbon.

As can be seen from Table 2, the propylene yield obtained in cracking of the simulated light cat naphtha over the commercial ZSM-5 catalyst is 28.4wt % propylene at 52.2wt % conversion. Ethylene yield was 7.1wt %. Butylene yield was 14.2wt %.

Example 5 (comparative)

In this example, the same blend of model compounds which was used in example 4 was cracked over a SAPO-11catalyst at a weight hourly space velocity of 3.1 $hr^{-1}$. As can be seen from Table 1, the propylene yield obtained in cracking of the simulated light cat naphtha over SAPO-11 catalyst is 30.8wt % at 52.1wt % conversion. Ethylene yield is 5.6wt %. Butylene yield was 12.9wt %.

Example 6

In this example, a blend consisting of 30%wt % 1-pentene, 32.0wt % 1-hexene, 16 wt % n-pentane, 22wt % n-hexane was prepared to simulate the $C_5$/C6 cut of the refinery light cat naphtha used in example 4 Separately, a blend consisting of 42.5wt % 1-heptene, 3.2wt % 1-octene, 38wt % n-heptane, 3.8wt % n-octane, 3.1wt % benzene, 9.2wt % toluene was prepared to simulate the $C_7$+ cut of the refinery light cat naphtha used in example 4. This simulated $C_5/C_6$ cut was cracked over SAPO-11 and the and $C_7$+ cut was cracked over ZSM-5 catalyst. The residence time in the second reaction was calculated to simulate the shortened residence time of a feed stream injected at a point further along the reactor than the injection point of the first fraction. The combined yields were calculated and tabulated in Table 2.

As can be seen from Table 2, propylene yield was 32.2wt % at 52.2wt % conversion.

Ethylene yield was 7.3wt %. Butylene yield was reduced to 8.5wt %. This example illustrates the benefit of splitting the feed and cracking the feed fractions separately over two different catalysts.

TABLE 1

| | Example 1 | Example 2 | Example 3 |
|---|---|---|---|
| Conversion (wt %) | 40.1 | 44.9 | 51.2 |
| ethylene (wt %) | 4.7 | 5.1 | 8.6 |
| propylene (wt %) | 19.8 | 24.4 | 26.0 |
| butylenes (wt %) | 12.5 | 11.8 | 11.4 |
| Light Sats (wt %) | 3.0 | 3.6 | 5.2 |
| C3 olefinincity | 95.6 | 95.7 | 95.2 |

TABLE 2

| | Example 4 | Example 5 | Example 6 |
|---|---|---|---|
| Conversion (wt %) | 52.2 | 52.1 | 55.5 |
| ethylene (wt %) | 7.1 | 5.6 | 7.3 |
| propylene (wt %) | 20.4 | 30.0 | 32.2 |
| butylenes (wt %) | 14.2 | 12.9 | 8.5 |
| Light Sats (wt %) | 2.4 | 2.8 | 4.1 |

All documents described herein are incorporated by reference herein, including any priority documents and/or testing procedures. As is apparent form the foregoing general description and the specific embodiments, while forms of the invention have been illustrated and described, various modifications can be made without departing from the spirit and scope of the invention. Accordingly it is not intended that the invention be limited thereby.

What is claimed is:

1. A process to produce propylene from a hydrocarbon feed stream comprising C5's and/or C6's comprising introducing the light portion of the feed stream into a reactor containing one or more catalysts separately from the heavy portion of the feed stream, wherein the light portion of the feedstream comprises that portion of the feed stream that has a boiling point range of 120° C. or less, and the heavy portion of the feed stream is that portion left over after the light portion is removed, wherein butylenes yield is reduced relative to the same process except for using a hydrocarbon feed from which said light portion is not removed.

2. The process of claim 1 wherein the hydrocarbon feedstream is a naphtha feed stream having a boiling range of from about 18° C. to about 220° C. comprising from about 5 to about 70 weight % paraffins and from about 10 to about 70 weight % olefins, and wherein reaction conditions include temperatures from about 500° C. to about 600° C.

3. The process of claim 1 wherein the light portion of the feed stream comprises at least 75 weight % of the C5's and/or C6's present in the feed stream.

4. The process of claim 1 wherein the light portion of the feed stream comprises at least 90 weight % of the C5's and/or C6's present in the feed stream.

5. The process of claim 1 wherein the light portion of the feed stream comprises at least 98 weight % of the C5's and/or C6's present in the feed stream.

6. The process of claim 1 wherein the feedstream is a catalytically cracked naphtha.

7. The process of claim 1 wherein the feedstream is a thermally cracked naphtha.

8. The process of claim 1 wherein the light portion is introduced into the reactor at a point before the point where the heavy portion of the hydrocarbon feed stream is introduced into the reactor.

9. The process of claim 8 wherein the heavy portion of the feed stream is introduced into the reactor at a point that is at least ⅓ of the total length of the reaction chamber apart from the point where the light portion is introduced.

10. The process of claim 8 wherein the heavy portion of the feed stream is introduced into the reactor at a point that is at least ½ of the total length of the reaction chamber apart from the point where the light portion is introduced.

11. The process of claim 8 wherein the heavy portion of the feed stream is introduced into the reactor at a point that is ⅓ to ½ of the total length of the reaction chamber apart from the point where the light portion is introduced.

12. The process of claim 8 wherein the catalyst comprises a medium pore silicoaluminophosphate catalyst.

13. The process of claim 8 wherein the catalyst comprises SAPO-11, RE SAPO-11, SAPO-41, and/or RE SAPO-41.

14. The process of claim 1 further comprising a second reactor wherein the light portion is introduced into a first reactor and the heavy portion of the feed stream is introduced into the second reactor.

15. The method of claim 14 wherein one or more silicoaluminophosphates are present in the first reactor.

16. The method of claim 14 wherein one or more medium pore aluminosilicate zeolites are present in the second reactor.

17. The method of claim 15 wherein the silicoaluminophosphate comprises one or more of SAPO-11, SAPO-41, RE SAPO-11, and RE-SAPO-41.

18. The method of claim 16 wherein the zeolite comprises one or more of ZSM-5, ZSM-11, ZSM-23, ZSM-48, and ZSM-22.

19. The process of claim 1 wherein the process is operated in the absence of a superfractionator.

20. The process of claim 1 wherein the product produced comprises at least 20 weight % propylene, based upon the weight of the total product produced.

21. The process of claim 1 wherein the hydrocarbon feed stream is a naphtha feed stream having a boiling range of from about 18° C. to about 220° C.

22. The process of claim 1 wherein the hydrocarbon feed stream is a naphtha feed stream having a boiling range of from about 18° C. to about 149° C.

23. A process of polymerizing propylene comprising obtaining propylene produced by the process of claim 1 and thereafter contacting the propylene, and optionally other olefins, with an olefin polymerization catalyst.

24. The process of claim 23 wherein the olefin polymerization catalyst comprises one or more Ziegler-Natta catalysts, metallocene catalysts, chromium catalysts, or vanadium catalysts.

25. The process of claim 1 wherein the light portion has a boiling point range of 100° C. or less.

26. The process of claim 1 wherein the light portion has a boiling point range of 80° C. or less.

27. A process to produce propylene from a hydrocarbon feed stream comprising C5's and/or C6's comprising introducing the light portion of the feed stream into a reactor containing one or more catalysts separately from the heavy portion of the feed stream, wherein the light portion of the feed stream comprises that portion of the feed stream that has a boiling point range of 120° C. or less, the heavy portion of the feed stream is that portion left over after the light portion is removed, and wherein the reactor is a staged bed reactor.

28. The process of claim 27 wherein the first staged bed comprises one or more medium pore aluminosilicate zeolite catalysts and the heavy portion of the feed stream is introduced into the reactor such that it will react with the zeolite catalysts.

29. The process of claim 28 wherein the second staged bed comprises one or more silicoaluminophosphates, and the light portion is introduced into the reactor such that it will react with the silicoaluminophosphates.

30. The process of claim 28 wherein the zeolite is ZSM-5, ZSM-11, ZSM-23, ZSM-48 and/or ZSM-22.

31. The process of claim 29 wherein the silicoaluminophosphate is SAPO-11, RE SAPO-11, SAPO-41, and/or RE SAPO-41.

* * * * *